United States Patent [19]

Anderson

[11] 4,240,662

[45] Dec. 23, 1980

[54] FOLDING SHAMPOO CHAIR

[76] Inventor: Bernice J. Anderson, 1805 Shirley St. SW., Atlanta, Ga. 30310

[21] Appl. No.: 65,445

[22] Filed: Aug. 10, 1979

[51] Int. Cl.[3] ..... A47C 1/04; A47C 4/00

[52] U.S. Cl. ..... 297/17; 297/34; 297/36; 297/182

[58] Field of Search ..... 297/17, 16, 36, 34, 297/380, 115, 113, 417, 191, 182; 4/185 HB

[56] References Cited

U.S. PATENT DOCUMENTS

| | | | |
|---|---|---|---|
| 1,673,988 | 6/1928 | Nitti | 297/17 |
| 2,697,480 | 12/1954 | DuBois | 297/191 X |
| 2,951,531 | 9/1960 | Dantes | 297/182 |
| 3,179,465 | 4/1965 | Roberts | 297/17 |
| 3,255,344 | 6/1966 | Suuronen | 297/182 |
| 3,674,306 | 7/1972 | Botney | 297/17 |

*Primary Examiner*—Francis K. Zugel

*Attorney, Agent, or Firm*—Newton, Hopkins & Ormsby

[57] ABSTRACT

Hingedly connected seat and back portions of a padded shampoo chair have storage recesses in corresponding sides thereof into which folding legs of the seat portion and a folding shoulder and head rest and arm rests of the back portion are nested when the chair is folded for carrying with its cushion surfaces arranged outwardly. Simplicity and compactness are included in an economical structure.

9 Claims, 6 Drawing Figures

FOLDING SHAMPOO CHAIR

BACKGROUND OF THE INVENTION

The objective of the invention is to provide a practical, lightweight, sturdy and economical folding shampoo chair which is readily portable to enable a beautician or hairdresser to make house calls to customers who are disabled or otherwise unable to visit the beauty salon. The chair may also be used in a beauty salon or the like, particularly in situations where floor space is at a premium. The chair would be very useful in nursing homes and some institutions or hospitals.

Prior U.S. Pat. No. 168,402 discloses a combination chair and traveling bag including seat and back rest portions and folding legs. The patented device contains no shoulder and head rest necessary for shampooing, has no arm rests, and folds in a reverse manner compared to the present invention.

Additional prior art U.S. patents pertaining to folding chairs of some general interest relative to the present invention are the following, made of record herein under 37 C.F.R. 1.56: U.S. Pat. Nos. 1,231,386, 2,966,204, 3,765,718.

Various additional features and advantages of the invention over the prior art will become apparent during the course of the following description.

DETAILED DESCRIPTION

Figure 1:
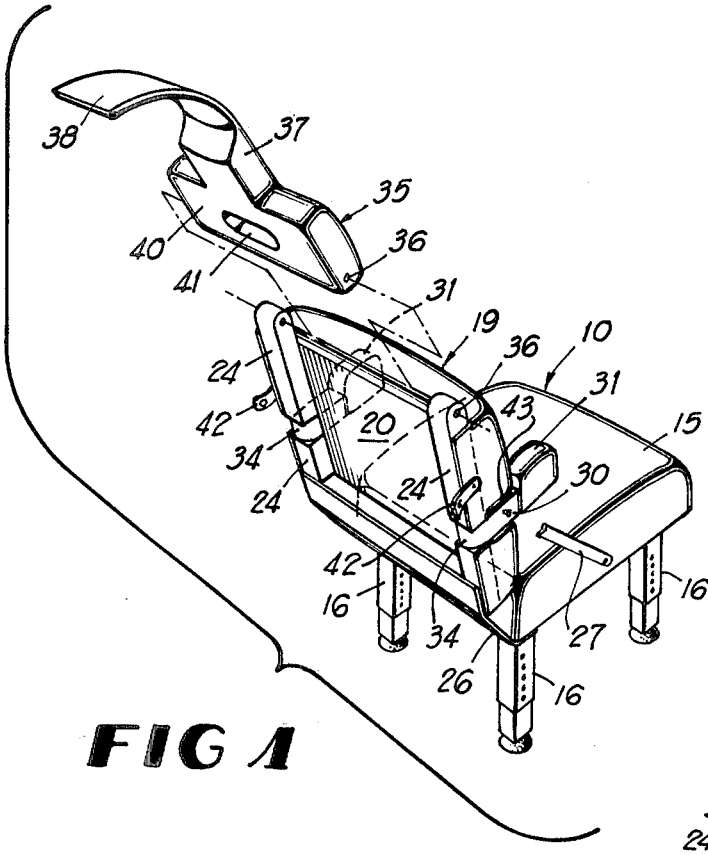
FIG. 1 is a partly exploded rear perspective view of a folding shampoo chair according to the invention.

Referring to the drawings in detail wherein like numerals designate like parts, a chair seat 10 includes a stiff bottom panel 11 secured to a rigid marginal frame at the bottom of the panel 11 composed of preferably square cross section bars 12. A storage space or recess 13 is defined by the marginal frame immediately below the panel 11. A cushion 14 covered with upholstery fabric 15 is suitably secured to the panel 11 in the chair seat.

Figure 6:
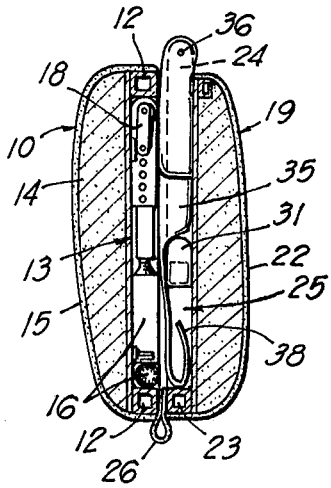
FIG. 6 is a vertical section taken through the folded chair.

Four adjustable height legs 16 have their tops pivoted at 17 within the interior corners of the marginal frame 12. In the manner of cardtable legs, the pivot axes of the legs 16 are perpendicular from corner-to-corner of the chair seat so that all of the legs may nest in the shallow recess 13 when folded, as shown in FIG. 6. Each leg 16 has a folding diagonal brace 18 interconnecting it with the panel 11 for safety and stability.

Figure 2:
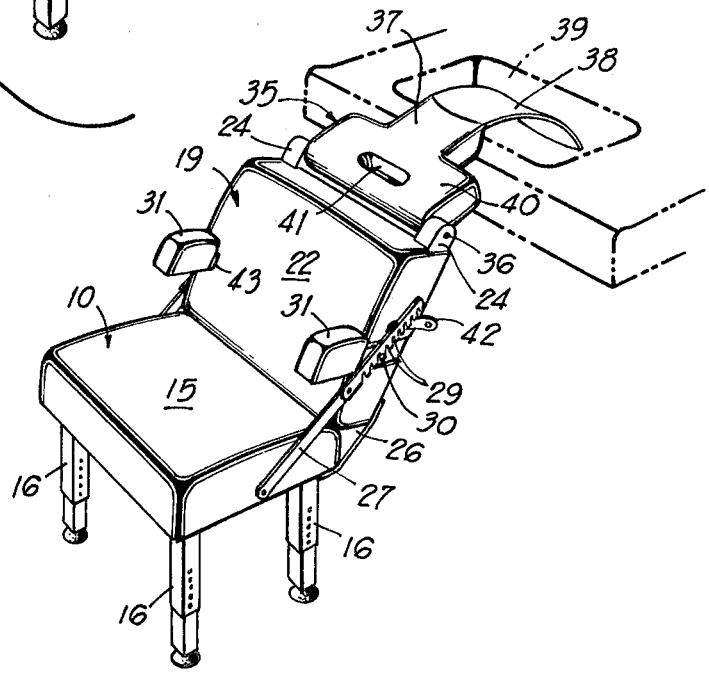
FIG. 2 is a front perspective view of the chair illustrating its use.

A seat back 19 includes a stiff panel 20 having its forward side covered by a cushion 21 having upholstery fabric 22 covering it. A three-sided rigid frame for the seat back 19 includes a bottom transverse bar 23 and a pair of side parallel frame bars 24 preferably of square cross section like the frame bars 12. A storage recess 25 is thus provided in the rear of seat back 19, which recess is open at its top. A durable fabric or other flexible material panel 26 having edge portions secured to the adjacent bars 12 and 23 forms a hinge between the seat 10 and chair back 19. A folding brace 27 at each side of the chair stabilizes the chair in the open use position and allows it to fold readily due to brake joint 28 in the folding brace. One section of the brace has adjusting teeth 29, as shown in FIG. 2, which are engageable selectively with a projecting pin 30 on one pivotal side arm rest 31, to be further described.

Figure 4:
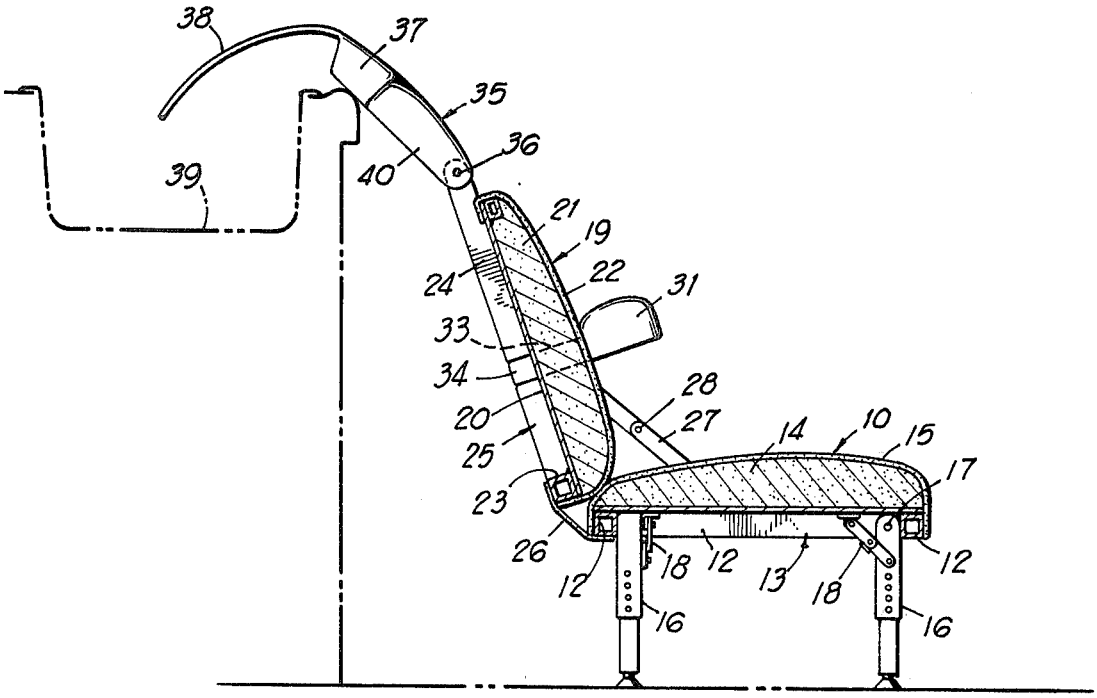
FIG. 4 is an enlarged vertical cross section of the chair partly in elevation.
Figure 5:
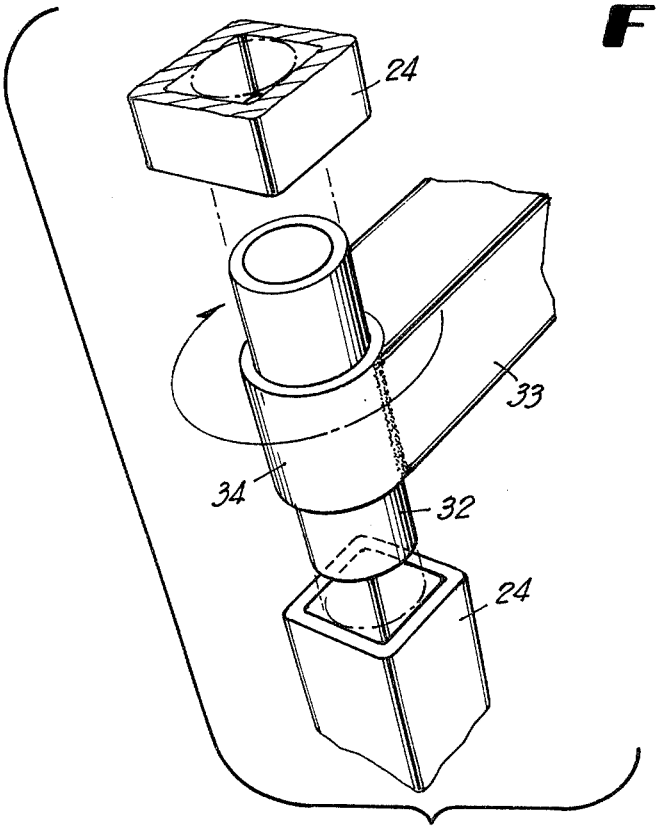
FIG. 5 is an enlarged fragmentary perspective view of an arm rest and pivot structure.

Referring to FIG. 5, the frame bars 24 of the chair back are divided near the vertical center of the back and rotatably mounted in the upper and lower sections of the divided bars are rotatable trunnion tubes 32 of the arm rest members 33 which have hubs 34 rigid with the trunnion tubes 32. By this means, each arm rest 31 is freely swingable outwardly from its normal use position shown in FIGS. 1, 2 and 4 toward a rear stowage position in the recess 25 in the chair back.

A combined shoulder and head rest 35 spans the top of chair back 19 and is pivotally connected at 36 between the tops of frame bars 24. The center head rest portion 37 has an elongated flexible tongue 38 which serves to support the hair of a user of the chair above a sink 39 or basin during the shampooing operation. The shoulder rest portion 40 has a hand hold 41 formed therethrough.

Figure 3:
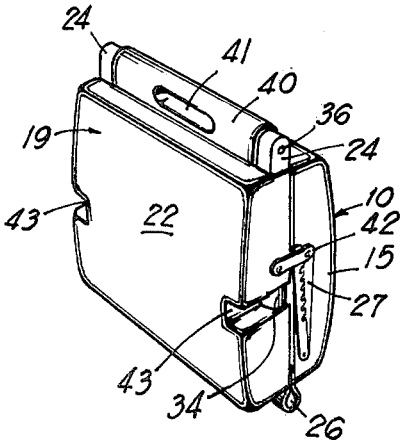
FIG. 3 is a perspective view of the chair folded for carrying.

Referring to FIGS. 3 and 6, when the shampoo chair is folded to a storage or transporting form, the brace 27 is separated from pin 30 and folded. The legs 16 are each folded so as to lie in the recess 13 of the seat 10. The arm rests 31 are swung outwardly and around to the rear of the back 19 where they will nest in the chamber or recess 25, and the shoulder and head rest 35 is swung downwardly and is also able to nest in the recess 25, the flexible tongue being suitably folded as shown in FIG. 6. At this point, the seat 10 and chair back 19 are folded upon each other with the two recesses 13 and 25 and the components contained therein in opposing relationship, as clearly shown in FIGS. 3 and 6. The cushioned and upholstered sides of the seat 10 and back 19 are arranged outermost in the folded unit. The fabric hinge 26 forms itself into an exterior loop 26, FIGS. 3 and 6. The chair may be secured in the folded condition by a pair of side straps 42 equipped with snap fasteners or equivalent means. In the folded state of the shoulder and head rest 35, the hand hold 41 projects above the upper end of the unit, FIG. 3, to facilitate carrying it like a suitcase or brief bag.

It should be noted that the opposite sides of the chair back 19 are notched at 43 to accommodate the arm rest members 33 when the arm rests are in their use positions.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A folding shampoo chair comprising a seat having a bottom storage recess and a back hinged to the seat and having a rear storage recess, legs pivotally attached to the seat and being swingable to stowed positions within said recess of the seat, arm rests and a combined shoulder and head rest pivoted on said back and being swingable to stowed positions within the recess of the back, and said seat and back being swingable to folded positions with the recesses of the seat and back in opposing relationship with said legs, arm rests and shoulder and head rest therein.

2. A folding shampoo chair as defined in claim 1, and said combined shoulder and head rest including a hand grip and said hand grip being positioned outwardly of corresponding ends of said seat and back when the chair is folded to facilitate carrying it.

3. A folding shampoo chair as defined in claim 2, and means on said chair to secure said seat and back releasably in folded relationship.

4. A folding shampoo chair as defined in claim 1, and said combined shoulder and head rest including an integral flexible hair supporting tongue adapted to be folded upon itself within said recess of said back.

5. A folding shampoo chair as defined in claim 1, and a folding adjustable stabilizing brace on at least one side of the chair having a connection with said hinged back and seat.

6. A folding shampoo chair as defined in claim 1, and a hinge element connected between said seat and back in the form of a flexible sheet.

7. A folding shampoo chair as defined in claim 1, and said seat and back each comprising a panel, a cushion attached to one side of the panel, and a marginal frame on the other side of the panel and defining with the panel said storage recess of the seat and back.

8. A folding shampoo chair as defined in claim 7, and the marginal frame of the seat being a four sided rectangular frame, the marginal frame of the back having three sides and being open at the top, two parallel sides of the marginal frame of said back extending somewhat above the top of said back, and said shoulder and head rest being pivoted to the tops of said two parallel sides above the top of the back, and said shoulder and head rest having a hand grip opening.

9. A folding shampoo chair as defined in claim 8, and said two sides of the frame of said back being divided and said arm rests having trunnion elements rotatable in openings of said divided sides.

* * * * *